United States Patent [19]

Sikkema et al.

[11] Patent Number: 5,050,661

[45] Date of Patent: Sep. 24, 1991

[54] BLIND FOR ROUNDED WINDOW SECTION

[76] Inventors: Arthur L. Sikkema, R.R. 5, Geneseo, Ill. 61254; Cynthia R. Hook, R.R. 1, Box 366, Thomson, Ill. 61285

[21] Appl. No.: 594,117

[22] Filed: Oct. 9, 1990

[51] Int. Cl.[5] ..... E06B 3/94

[52] U.S. Cl. ..... 160/84.1; 160/134

[58] Field of Search ..... 160/84.1, 134, 279, 160/340, 341, 370, 90, 32, 35

[56] References Cited

U.S. PATENT DOCUMENTS

| | | | |
|---|---|---|---|
| 602,967 | 4/1898 | Wells | 160/134 |
| 1,609,877 | 12/1926 | Kendall | 160/134 X |
| 3,386,106 | 6/1968 | Clemens | 160/84.1 X |
| 4,776,380 | 10/1988 | Lester | 160/134 |
| 4,858,669 | 8/1989 | Vinson | 160/134 |
| 4,934,436 | 6/1990 | Schnebly | 160/84.1 |
| 4,979,551 | 12/1990 | Sahon | 160/84.1 |

*Primary Examiner*—David M. Purol

[57] ABSTRACT

A window blind for an arched or rounded window in which the blind when open rests in a horizontal stack on the base of the window and which closes to fan shaped disposition. The inner end of the stack is carried by a vertical slot and pivot means that permits the inner end of the stack to shift vertically in a plane that includes the axis about which the rounded outer portions of the window frame is formed. As the blind is closed to a fan shaped condition, the slot and pivot connection permits the inner end of the stack to drop so that the blind itself may be substantially the length of the radius of the circular window pane. Cord controls are provided so that an upward force is applied to the stacked blind to initiate closing of the blind.

10 Claims, 4 Drawing Sheets

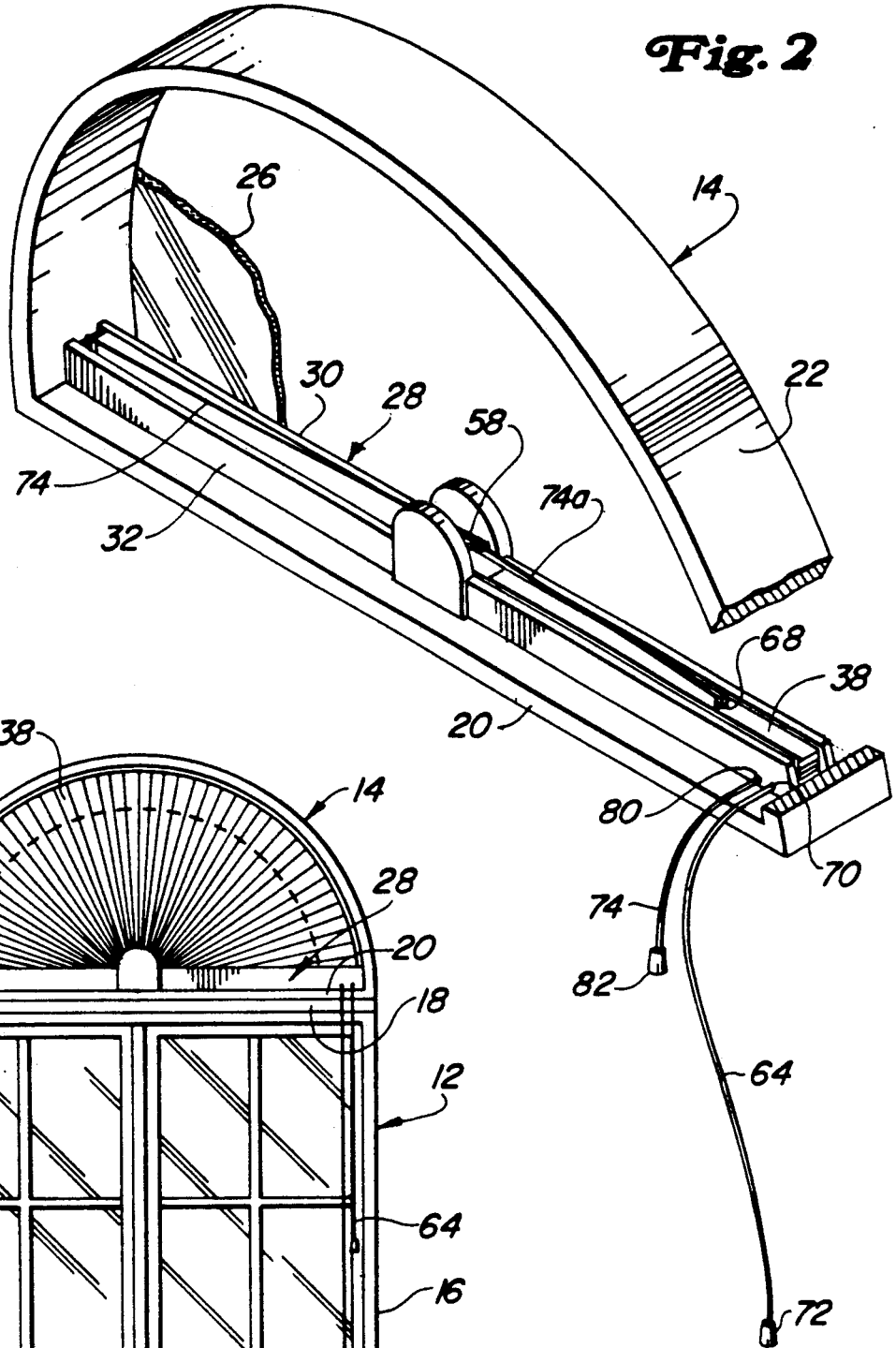
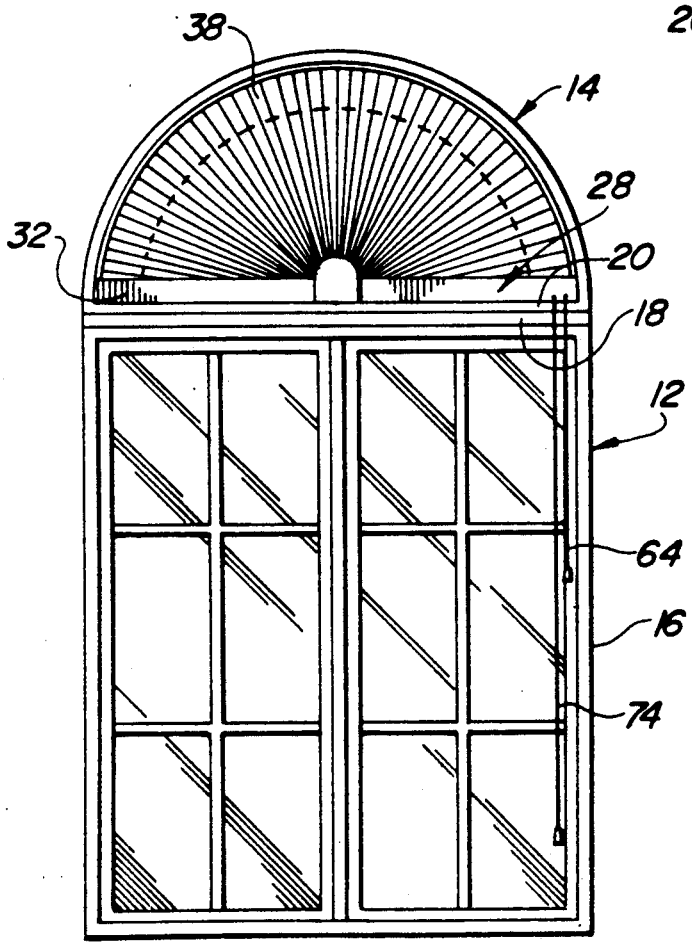
Fig. 1

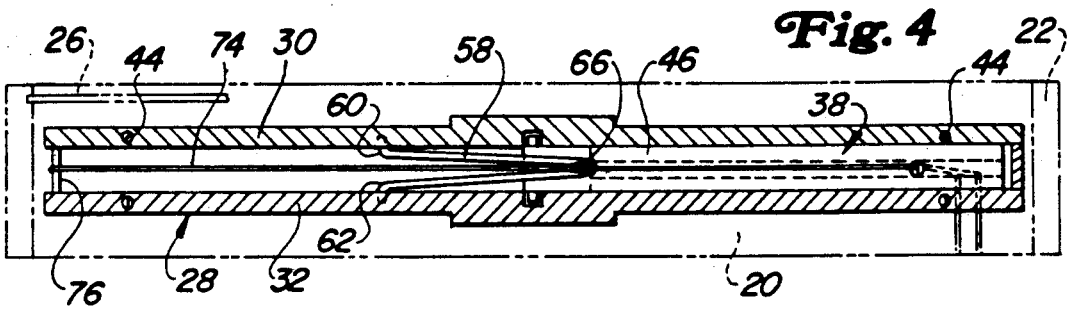
Fig. 4
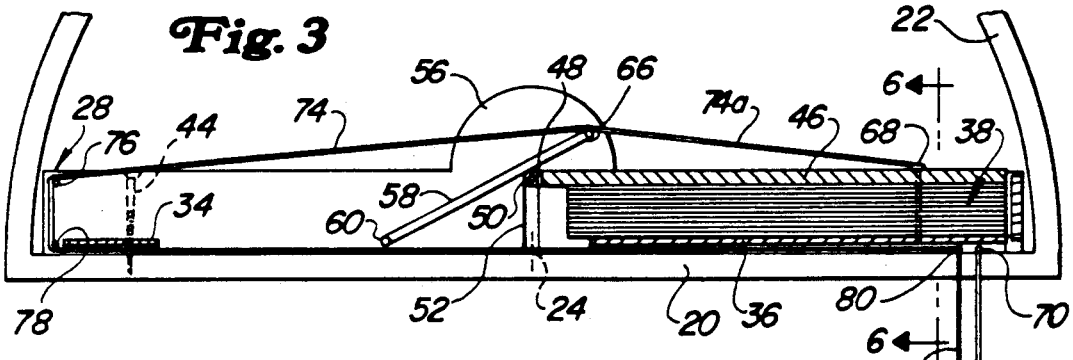
Fig. 3
Fig. 6
Fig. 7
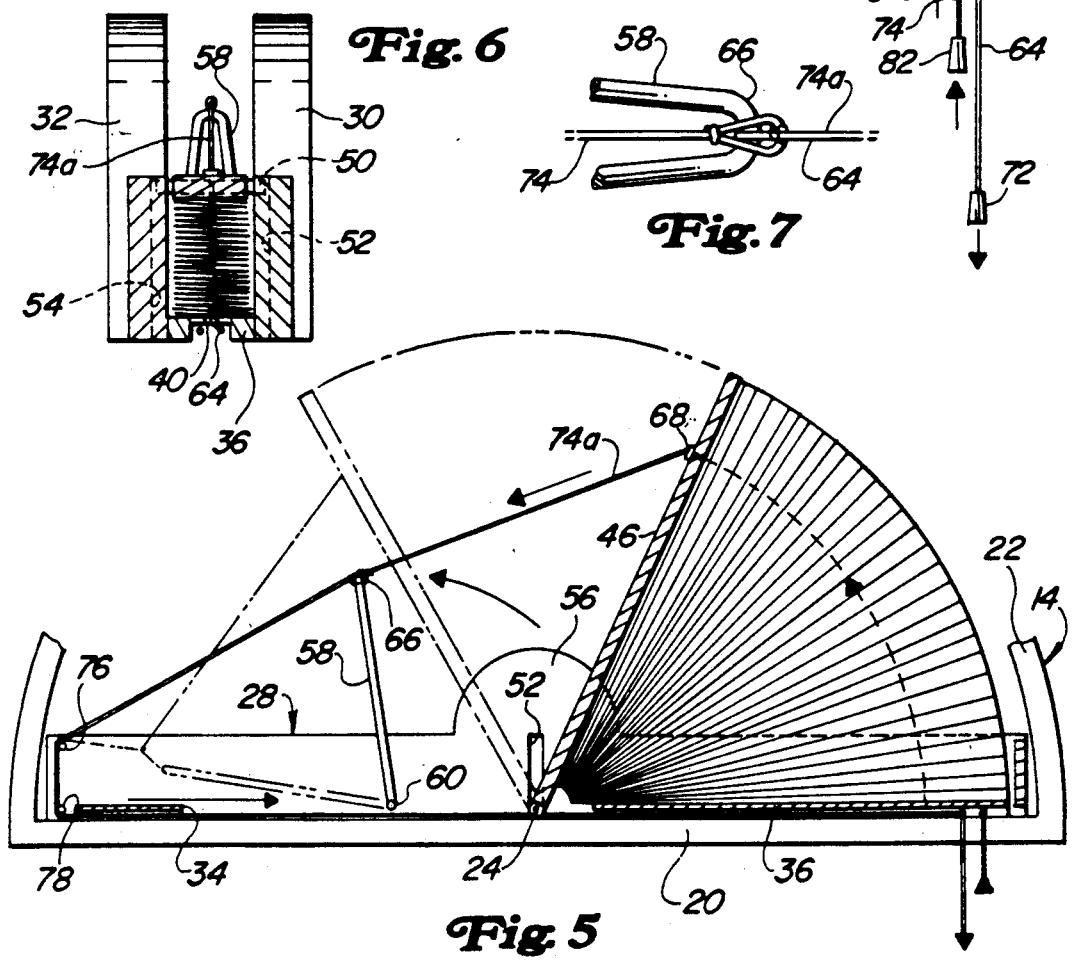
Fig. 5

BLIND FOR ROUNDED WINDOW SECTION

This invention relates to a fan-shaped blind for use on a rounded window section and to the controls for moving the blind between its closed and open positions.

BACKGROUND OF THE INVENTION

A conventional pleated type window shade or blind for an arched or rounded window will, when it is desired to have the shade open, normally rest in a horizontal stack on the base frame of the window and will extend from an inner end at the vertical center of the window toward the inner side of the circular frame of the window. Normally the inner end of the shade is carried on horizontal pivot about which the shade may be swung between an open or stacked position and a closed fan-shaped position. The problem that is created occurs because the shade when in its stacked position has a vertical height or dimension to it. This prevents the pivot from being located on the axis about which the circular portion of the window frame is formed. If the pivot is located at the level of the upper side of the stacked shade, the shade is reduced in length substantially the height of the stack in order to prevent interference between the outer edge of the shade and the circular window frame upon the shade being moved to its closed position. The gap that is left between edge and frame gives the impression that the shade is improperly fitted.

With the above in mind, it is the primary object of the present invention to provide a mounting for a fan-shaped shade which will permit the aforesaid pivot to shift vertically between the level of the stack and the axis about which the circular window frame is formed.

More specifically it is an object of the invention to provide a shade or blind structure for an arch type or circular window section. The blind structure is composed of a base member that is fixed to the window frame. The base member has a vertical slot at the center of the window that extends through the axis of the circular window section and ends substantially at the upper level of the blind when in its stacked position. A horizontal pin fixed to the inner end of the blind extends into the slot and permits the inner end of the blind to vertically self-adjust as needed upon the blind being opened or closed.

It is a further object of the invention to provide a shade structure for arched type windows of relatively large size. Such windows normally have the upper circular portions divided into two sections, each of which is 90 degrees of a circle. For such a window it is proposed to provide a shade structure for each side of the window. The shade structure is composed of two sections of frame, one for each half of the window. Each blind frame will have a horizontal base portion and a vertical portion. At the juncture of the horizontal and vertical portions there is provided a vertical slot, of the nature previously noted, that receives a pin on the inner end of the blind and which operates to self-adjust in the slot as previously described.

It is a further object of the invention to provide pull cords for the blind and to provide control elements on the blind support to position the cords so as to create vertical forces on the blind as needed. These and other objects of the invention will become more apparent as the features of the invention are understood from the following description.

DESCRIPTION OF THE DRAWINGS

FIG. 1 is a front view of an arch type window structure using the blind structure of the invention.

FIG. 2 is a perspective view, with portions broken away, of the circular window frame and the blind structure of the invention.

FIG. 3 is a vertical sectional view of the blind structure taken substantially along the transverse center line of the blind structure.

FIG. 4 is a transverse sectional view of the blind structure. Part of the window pane is shown in phantom.

FIG. 5 is a view similar to FIG. 3 but showing the blind in a semi-closed position.

FIG. 6 is a sectional view taken along line 6—6 of FIG. 3.

FIG. 7 is an enlarged view of the connections between the pull cords and a cord control lever.

BRIEF DESCRIPTION OF THE INVENTION

Figure 8:
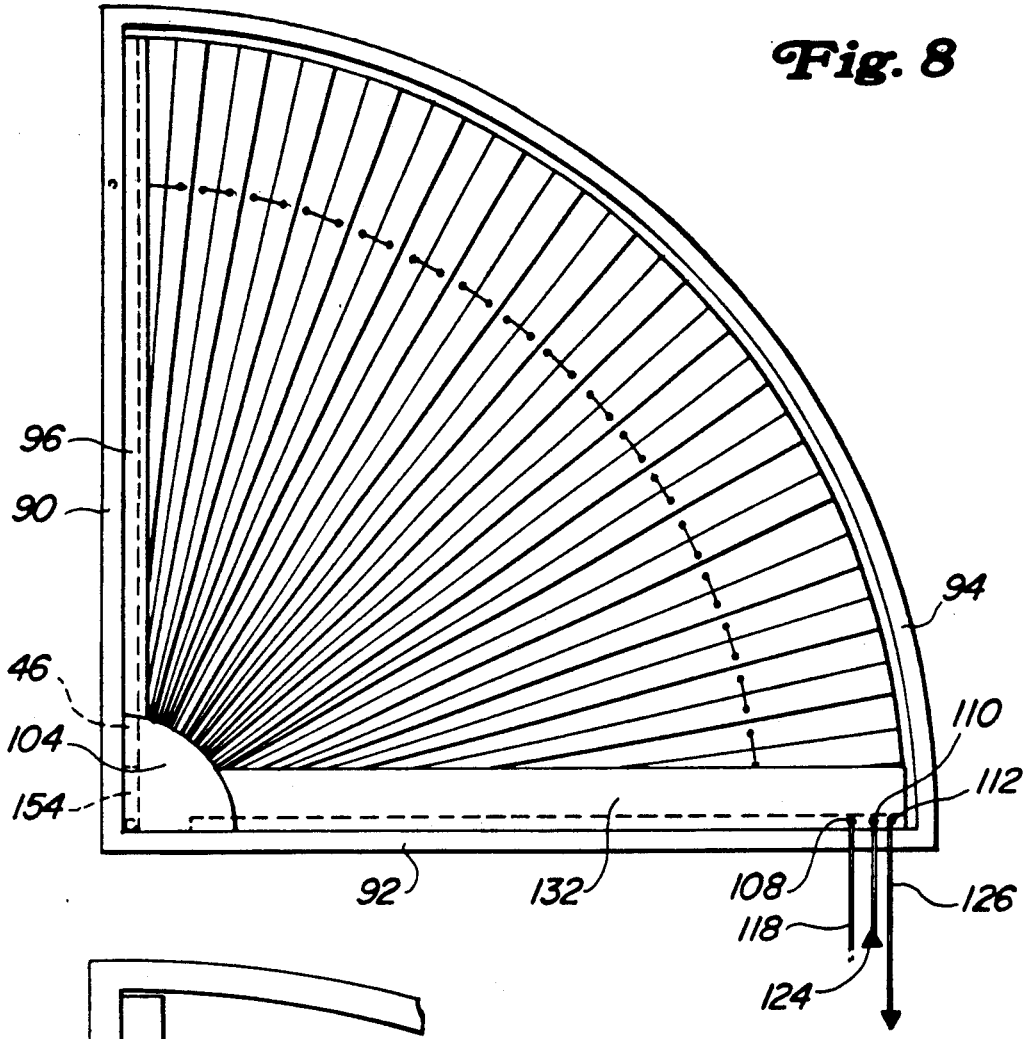
FIG. 8 is a front view of a modified form of the invention and showing the shade in a closed position

Referring to FIG. 1, a window structure is composed of a rectangular shaped lower multi-paneled main section 12 and an upper semi-circular section 14. The lower section 12 is suitably framed, as at 16, and the frame 16 includes an upper horizontal frame member 18. The upper semi-circular section 14 is composed a horizontal base 20 fixed to the plate 18 by any suitable means and a circular frame section 22, which in this particular form of the invention is semi-circular. The frame section 22 is formed by a radius having its axis, signified by the reference number 24, located centrally on the upper surface of base 20. A window pane shown partially at 26 is suitably mounted on the base 20 and semi-circular frame section 22.

Mounted on the base plate 20 is a blind supporting structure 28 composed of opposed vertical walls 30, 32 that extend transversely across the plate 20 substantially the full length of the base plate 20. The walls 30, 32 are joined at their lower edges by left and right horizontal walls 34, 36 that are spaced apart to permit movement of parts of blind 38 in the area of axis 24. As can best be seen in FIG. 6, the vertical walls 30, 32 form with the horizontal walls 34, 36 an upwardly opening trough that receive portions of the blind 38 as needed. The walls 34, 36 have transversely extending channels or grooves 40 in their lower surfaces that form with the upper surface of base plate 20 tunnels through which control cords may be played. Screw members 44 extend through the vertical walls 30, 32 and secure the entire blind frame 28 to base plate 20.

The blind 38 is of the pleated type which, when in a folded condition as shown in FIG. 3, comprises a horizontal stack of closely layered folds. When in such a stack the blind is positioned within the trough on the right half side of the window. The lower-most fold is fixed to the wall 36. The upper-most fold is fixed to a movable arm or plate 46 that has extending portion 48 projecting over the axis 24 of the circular window frame 22. A fore and aft extending pivot pin 50 is mounted on the projecting portion 48 and is received in opposed vertical slots 52, 54 formed in the internal surfaces of walls 30, 32. The slots extend upwardly in a vertical plane that contains axis 24 to upper ends substantially at the upper level of the stacked blind. To accommodate the slots and cover other structure the plates 30 ,32 are enlarged at 56 at the center of the window structure. The radial length of the blind is substantially the full radius of the semi-circular frame 22 although there is provided a small gap between the outer edge of the blind and the inner surface of the window frame 22 to ensure that the blind will be free to shift without interference with the frame.

A V-shaped control arm or lever 58 is mounted on the supporting structure 28 on the left-hand side of the trough structure. The lower ends of the diverging legs of the lever 58 flare horizontally outwardly at 60, 62 to be received in suitable horizontal and axial aligned openings in the inner surfaces of plates 30, 32. The lever extends over the blind 38 when it is stacked as shown in FIG. 3. An apex end 66 of the control arm 58 is connected to the blind arm 46 by cord **74*a* that is bolted at 68 to the arm 46. A blind control cord 64 is also connected by bolt 68 to arm 46. The cord 64 extends through the blind folds or pleats and wall 36 and into channel 38 where it exits through opening 70. For convenience the cord 64 carries at its free end a hand-gripping element 72**.

As shown in FIG. 7, the cord **74*a* is also connected to a main control cord 74 at the apex portion 66 of control arm 58. The cord 74 extends from apex portion 66 around a pair of directional pins 76, 78 at the left end of the blind holding frame 28 which redirects the cord 74 to the opposite or right end of walls 30, 32 via the tunnel 38 and through an opening 80 in wall 32. The cord 74 has a lower free end which carries a gripping element 82. The free and portions of cords 64, 74** hang vertically side by side at the right end portion of the window and shade so that the shade may be adjusted as desired from that side.

The shade structure operates as follows. When the shade 38 is in the open position as shown in FIG. 3 and 4, it is horizontally stacked in the right half portion of the trough formed by walls 30, 32, 36. The control arm or lever 58 rests in an inclined disposition against the inner end of blind arm 46 and has its apex end portion 66 at a level above the arm 46. When it is desired to shut the shade, the free end of cord 74 is pulled downwardly. This exerts a counter clockwise force on control arm 58. Since the apex portion 66 of arm 58 is above the level of blind arm 46 the force on the arm 46 by cord **74*a* is inclined. The vertical component of this inclined force causes the arm 46 to move vertically about its pivot 50. As the arm 46 rises, as shown in FIG. 5, the weight of the arm and its blind and the then downward pull of cord 74*a* will cause the pivot pin 50 to drop in the slots 52, 54 to relocate substantially on the axis 24 of the semi-circular window frame section 22. Therefore, the pin 50 and slots 52, 54 operate as vertically self-adjusting pivot means for mounting the arm 46** on the trough structure. By having such pivot means the radial dimension of the fan-shaped blind may be substantially the same as the radius of the circular window frame.

When it is desired to again open the blind, cord 64 is pulled downwardly and the arm 46 will arise from the left side of the trough structure and move in a clockwise direction. As the blind approaches the stacked condition, as shown in FIG. 3, it will cause the pin 45 to shift to the top of slots 52, 54.

Referring to the modified form of the invention as shown in FIGS. 8–11, there is therein shown a partial or quarter circular window. The window has a vertical frame member 90 joined at its lower end to a horizontal frame member 92. The frame members 90, 92 are connected at their outer ends by a circular frame member 94 having a circular expanse of ninety degrees. A glass pane, not shown, is mounted on the frame members 90–94. Two fore and aft spaced and parallel members 96, 98 are bolted at 100, 102 to the vertical frame member 90. The lower ends of members 96, 98 are rigid with circular cover plates 104, 106. Projecting rigidly and horizontally outwardly from the outer edges of the circular plates 104, 106 are upright horizontal walls 130, 132. The lower edges of the walls 130, 132 are rigidly joined by a horizontal wall 136 that is grooved at 138 on its underside to form a cord tunnel with the upper surface of the horizontal frame member 92. The inner surfaces of the circular plates 104, 106 are vertically grooved at 152 154 to receive opposite ends of a horizontal pivot pin 156 on the inner end of a blind arm 146. The lower ends of grooves 152, 154 are located substantially on the axis of the circular window frame member 94. The vertical walls 130, 132 are fixed to the horizontal window frame member 92 by screws 140. Cord openings 108, 110, 112 are provided in the outer end of wall 132 and open into the groove 138.

A pleated blind 114 is connected to the blind arm 146 amd wall 136. The length of the blind 114 is substantially equal to the radius of the frame member 94. Bolted at 116 to the arm 146 is one end of pull cord 118. The cord extends upwardly from the bolt 116 over a horizontal directional pin 120 and from there downwardly to a second directional pin 122 from where it is directed horizontally outwardly through the groove 138 to the opening 108 where it exits from the blind structure. Also fixed to the bolt 116 is a second control cord 124 that extends downwardly through openings in each of the pleats of the blind 114 and horizontal wall portion 136. The cord extends into the groove 138 until it reaches and exits through opening 110. A third control cord 126 is looped at 128 around the cord 118 and extends from the loop 128 over the inner end of arm 146 and from thence downward around the directional pin 122 and through the channel 138. The cord 126 leaves the channel 138 through opening 112.

Figure 9:
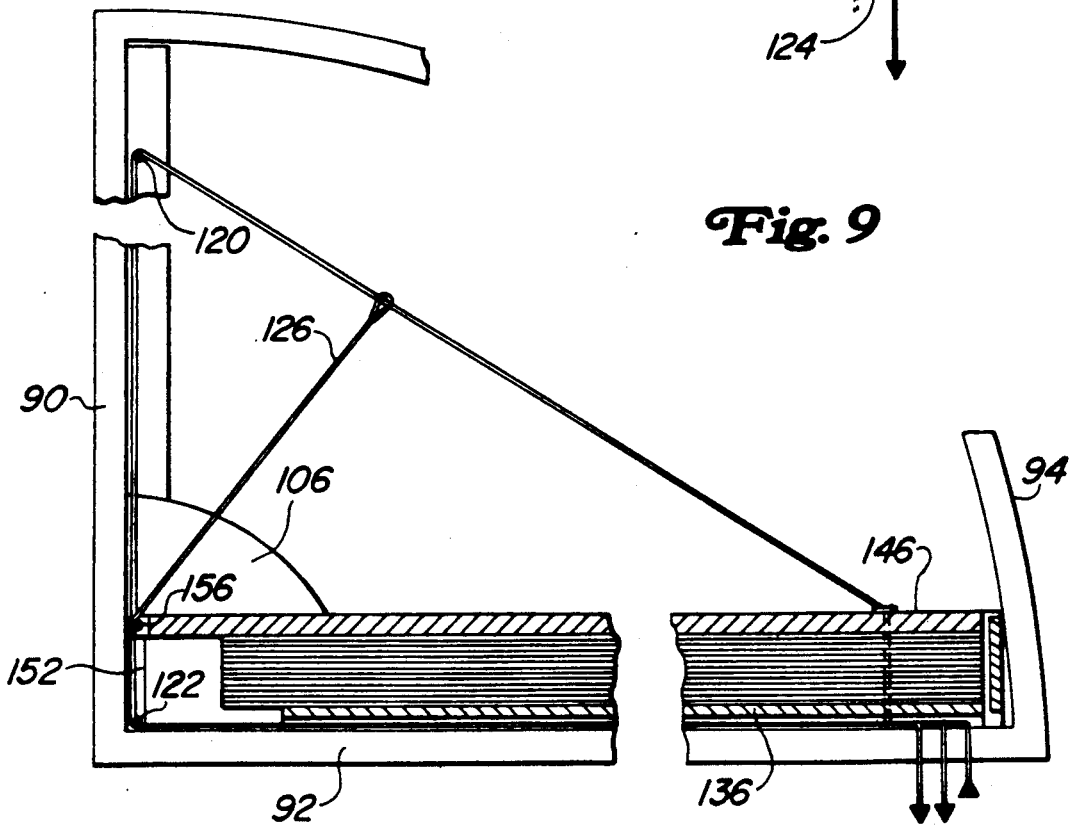
FIG. 9 is an enlarged vertical sectional view of the blade or blind structure shown in FIG. 8. The shade is shown in the open position.
Figure 10:
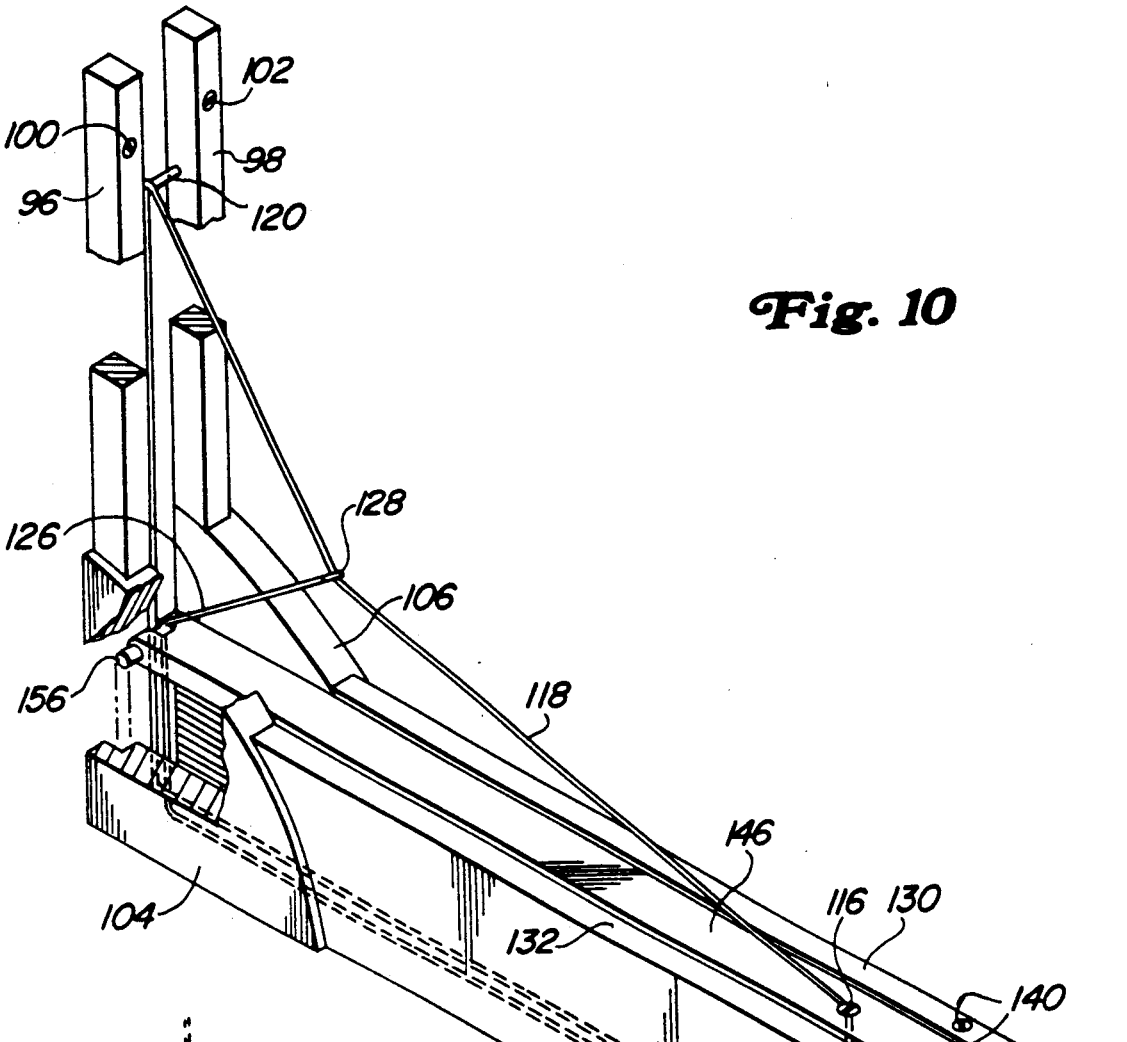
FIG. 10 is an enlarged perspective view of the structure shown in FIG. 8, with portions broken away to show internal mechanism.
Figure 11:
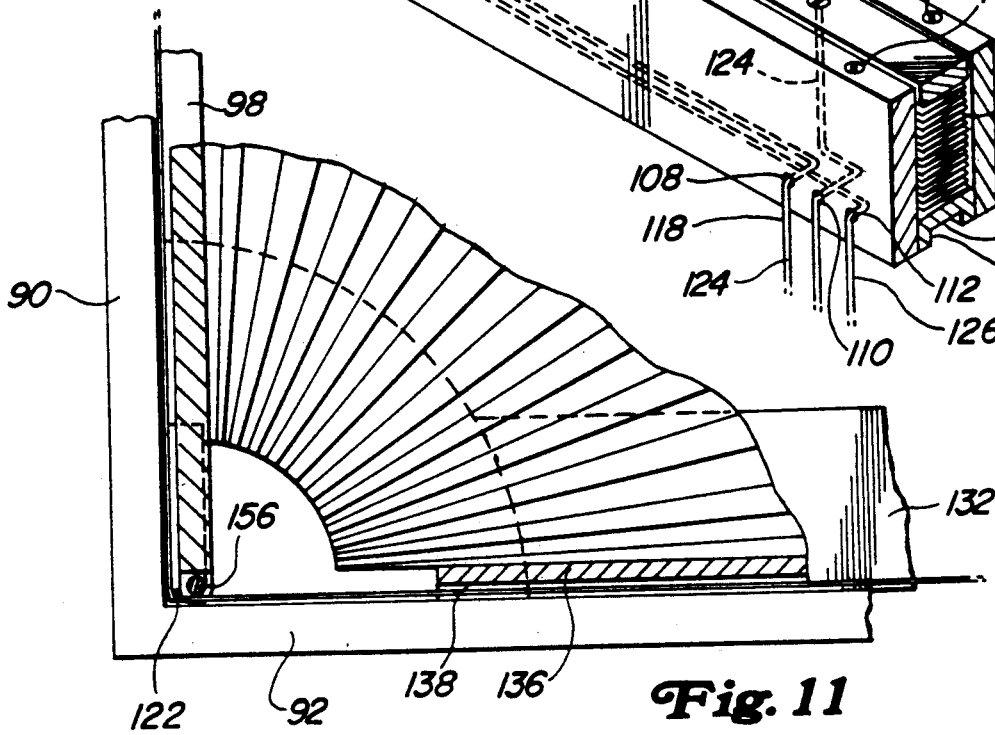
FIG. 11 is an enlarged vertical sectional view showing the corner portion of the structure shown in FIG. 8.

In operation the blind 114 may be moved from it open or stacked condition as shown in FIGS. 9 and 10 to its fan-shaped position as shown in FIG. 8 and 11 by pulling on the free end of control cord 118. Such will create an upwardly inclined force on arm 146 causing it and the shade to shift angularly about its inner end or pivot pin 156. As the arm 146 moves upwardly, its weight and the weight of the blind will create a gravitational force on the arm 146 causing the pin 156 to move downwardly in the slots or grooves 152, 154 until the pin 156 rests on the axis of the circular frame member 94. This action permits the length of the blind to approximate the radius of the circular frame member and still permit the blind to be horizontally stacked.

The blind may be opened by pulling on the control cord 124. This will cause the arm 146 and blind 114 to drop to its stacked position as shown in FIGS. 9 and 10. This could, of course, leave much of the cord 118 exposed thereby leaving a rather unattractive arrangement. However, by pulling downwardly on the third cord 126, the section of cord 118 between bolt 116 and direction pin 120 will be shifted downwardly toward the inner end of arm 146. This section of cord 118 will then be composed of a vertical portion hidden by members 96, 98 and a horizontal section lying on top of the arm 146 but nevertheless hidden from view.

What is claimed is:

1. A blind structure for a circular window having a horizontal base and an outer circular frame member formed about an axis adjacent the surface of the base, said blind structure comprising: a U-shaped upwardly opening trough structure fixed to and extending along the base; a pleated fan-shaped blind adapted to lie when in repose in a horizontal stack in said trough structure, said blind including an arm fixed to an upper pleat and having a lower pleat fixed to said trough structure, the length of said pleated blind being substantially the radius of said circular frame member and said arm having an inner end located in the area of said axis; vertically self-adjusting horizontal pivot means connecting said inner end of said arm to said trough structure, the axis of said pivot means being shiftable vertically between positions coextensive with said axis of said circular frame member and vertically above the latter axis; control cords connected to said arm, one of said cords used to swing said arm and blind from a fully open position in which said blind is in said horizontal stack and in said trough structure to a fan-shaped disposition in which it covers said window, and another of said cords being used to return the blind to said horizontal stack; and a cord control element being positioned relative to said one control cord so that the direction of force between it and said blind arm will have a vertical upward component.

2. The invention defined in claim 1 in which said vertically self-adjusting horizontal pivot means is opposed vertical slots in vertical walls of said U-shaped upwardly opening trough structure and a horizontal pivot member fixed to said inner end of said arm and having opposite ends thereof residing in said slots, and in which the lower ends of said vertical slots are horizontally aligned with said axis about which the circular frame member is formed and extend upwardly to at least the height of said horizontal stack.

3. The invention defined in claim 1 in which said circular frame member is half a circle and said vertically self-adjusting horizontal pivot means moves in a vertical plane that contains said axis about which the circular frame member is formed.

4. The invention defined in claim 3 in which said control element is a lever horizontally pivotally connected to said trough structure and having an upper end that is above said blind when in said horizontal stack, and said one cord is connected to the lever and said upper end is connected to said arm.

5. The invention defined in claim 4 in which vertical walls forming opposit sides of said trough structure are enlarged in the area of said axis so as to substantially cover said lever and cords.

6. The invention defined in claim 3 in which said horizontal stack extends outwardly to one side of said axis and said lever is connected to the other side of said axis and to said trough structure.

7. The invention defined in claim 6 in which said lever may swing outwardly and come to rest in said trough structure beneath said arm when said blind is in a fully closed position.

8. The invention defined in claim 1 in which said outer circular frame member is a quarter circle and the window has a vertical frame member extending between said circular frame member and said base, and said cord control element is a member fixed to said vertical frame member at a level above said arm when said blind is in said horizontal stack and over which said one cord is played so that a section of said one cord is inclined between said member and said arm.

9. The invention defined in claim 8 further characterized by a third cord slidably connected to said section of said one cord and extending therefrom to an area at the juncture between said vertical frame member and said horizontal base whereby said third cord may draw said section of said one cord into vertical and horizontal portions lying closely adjacent said vertical frame member and said horizontal base respectively.

10. The invention defined in claim 1 in which said horizontal trough structure has on its underside a tunnel through which said cords extend for exiting at one side of said window.

* * * * *